US006120721A

United States Patent [19]

D'Amato

[11] Patent Number: 6,120,721

[45] Date of Patent: Sep. 19, 2000

[54] PROCESS FOR THE PRODUCTION OF PILE-UP LIDS

[75] Inventor: Gianfranco D'Amato, Naples, Italy

[73] Assignee: Seda, S.p.A., Arzano, Italy

[21] Appl. No.: 09/236,342

[22] Filed: Jan. 25, 1999

Related U.S. Application Data

[62] Division of application No. 08/907,880, Aug. 11, 1997, Pat. No. 6,004,125.

[30] Foreign Application Priority Data

Aug. 9, 1996 [IT] Italy ..... RM96A0572

[51] Int. Cl.[7] ..... B29C 43/26; B29C 43/50

[52] U.S. Cl. ..... 264/320; 264/296; 425/396; 206/508; 220/781

[58] Field of Search ..... 264/294, 296, 264/319, 320, 322; 425/394, 395, 396, 398, 400, 436 R, DIG. 127; 206/508; 220/781

[56] References Cited

U.S. PATENT DOCUMENTS

| | | | |
|---|---|---|---|
| 3,200,442 | 8/1965 | Haller | 425/398 |
| 3,403,649 | 10/1968 | Geiger et al. | 425/398 |
| 4,228,121 | 10/1980 | Meadors | 264/291 |
| 4,278,585 | 7/1981 | Arndt et al. | 425/403 |
| 5,253,995 | 10/1993 | Romstad et al. | 425/522 |

FOREIGN PATENT DOCUMENTS

4429057 A1 2/1996 Germany .

*Primary Examiner*—Jan H. Silbaugh
*Assistant Examiner*—Michael I. Poe
*Attorney, Agent, or Firm*—Browdy and Neimark, PLLC

[57] ABSTRACT

A process for the production of pile-up lids, each of which comprises an upper wall (1) and an element (2) arranged around the perimeter of said upper wall (1) and which forms a lip (3) protruding above said upper wall (1), and skirt (4) extending below said upper wall (1); the process includes the steps of bringing together in a synchronous manner external sector elements (9) and internal sector elements (10) in radially opposite directions so that, owing to the forced approach of the contact surfaces of the external and internal sector elements (9, 10) with said upper lip (3) of said lid interposed between them, a reeding pressure-molding is obtained on both the inner and the outer surfaces of said upper lip (3), giving said lip (3) an outline to allow piling up on other similar lids.

1 Claim, 4 Drawing Sheets

A

B

C

PROCESS FOR THE PRODUCTION OF PILE-UP LIDS

This is a division of parent application Ser. No. 08/907,880, filed Aug. 11, 1997, now U.S. Pat. No. 6,004,125, the entire contents of which are hereby incorporated.

BACKGROUND OF THE INVENTION

The present invention relates to a process for the production of pile-up lids.

1. Technical Field of the Invention

Conventional lids are generally formed by a perimetric element, apt to be positioned on the outside edge of a container to be closed, and by an upper wall closing the perimetric element.

2. Prior Art

With regard to a particular structure of lid, generally circular in shape, of the kind, for example, that is used in the ice cream containers and the like, it is formed by a ring-shaped element at the top of which a disk is inserted to close the upper opening of the container, which disk has its circumference edge folded upwards, on which edge the upper edge of said ring-shaped element is in turn folded over and fixed. In this way a stable complex is formed.

Furthermore, in this type of lid, a ring-shaped bead is formed around the circumference of the surface of said ring-shaped element, said bead having the function of creating a snap-on engagement with the protruding edge of the associated container at its top.

However, these known lids have the disadvantage that they cannot be piled up one on top of another because, due to their shape, the diameters of the top and bottom edges of the lids are identical.

This entails a number of troubles during storage and transport, as said lids must be stored in large containers, generally plastic bags, and must be inserted into the inside thereof loose, with a consequent use of a great deal of space. Furthermore, when stored in this way they are subject to knocks, folding, breakage and generally, due to the possibility of free movement within the packing, to rubbing, which can result in deterioration of the surface appearance and flatness thereof.

Furthermore, the above conditions cause a number of troubles for the operator when taking up said lids from their packing for loading them, in a pile, into the operating machine in order to carry out their insertion onto the relative containers, resulting in considerable loss of time.

OBJECT AND SUMMARY OF THE INVENTION

The object of the present invention is therefore to provide a process and an apparatus for the production of pile-up lids so as to eliminate the problems described above, giving a surprising simplification of the operation of storage and transport of said lids, as well as their loading into the operating machine by the operator, with a considerable reduction of the storage space and time required and consequently improved productivity.

According to the present invention, a process is therefore provided for the production of pile-up lids, each of which is formed by a closing upper wall and by an element arranged around the perimeter of said upper wall and which forms a lip protruding above said upper wall, and a skirt extending below said upper wall;

the process being characterized by the following steps:

positioning a lid on a supporting element;

bringing said supporting element near an area in a first frame that is delimited by a plurality of first external sector elements and by a plurality of second internal sector elements, until it comes into contact with said plurality of first and second sector elements, said first and second sector elements having respective indentations on the respective contact surfaces; and bringing said first external sector elements and said second internal sector elements together in synchrony in radially opposite directions, said first and second sector elements being movable on the same plane in such a way that, owing to the forced approach of said contact surfaces of the first and second sector elements with said upper lip of said lid inserted between them, a reeding pressure moulding is achieved on both the external and the internal surfaces of said upper lip, so as to give said lip a reduced perimeter outline apt to allow piling up on other similar lids, after extraction of the lid from said supporting element.

BRIEF DESCRIPTION OF THE DRAWINGS

The present invention will be illustrated in greater detail in the following by description of a preferred embodiment thereof, given as a non-limiting example, and with reference to the enclosed drawings, in which.

DETAILED DESCRIPTION OF PREFERRED EMBODIMENT(S) OF THE INVENTION

Figure 1:
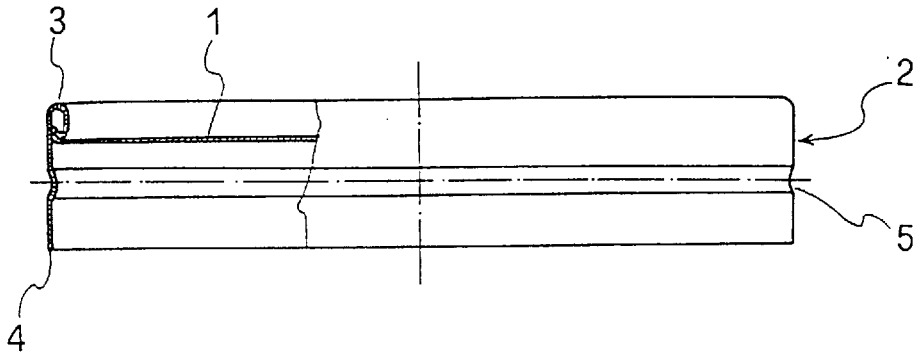
FIG. 1(A) is a view, partially in longitudinal section, of the lid before the process according to the present invention.
FIG. 1(B) is a view, partially in longitudinal section, of the lid after the process according to the present invention.
FIG. 1(C) is a section view which partially shows three lids piled one on top of the other, after the process according to the present invention.
Figure 1:
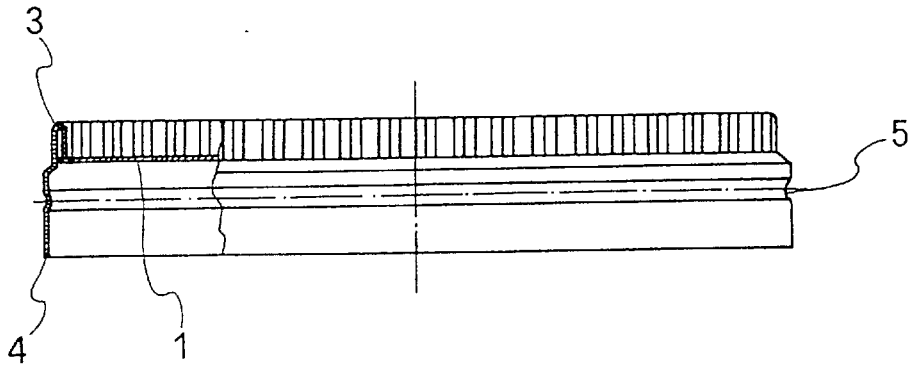
Figure 1:
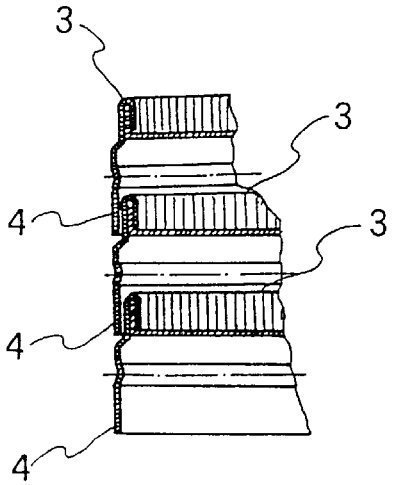

With reference now to FIG. 1(A), it shows, partially in longitudinal section, the lid before the pressure moulding process of the present invention.

It must be noted that the present embodiment relates to a circular lid and to an apparatus suitable to carry out the process for pile-up lids of a circular shape.

With reference to FIG. 1(A), the lid is formed by an upper wall 1 and by an element 2 arranged around the perimeter of said upper wall 1. The element 2 forms a lip 3 protruding from and turned up above said upper wall 1, and a skirt 4 extending below said upper wall 1. At the central part of the skirt 4 a bead 5 is formed, the cavity of which faces inward along the whole of its perimeter. The latter is apt to snap engage with the complementary protruding edge formed at the top of the container with which it is intended to co-operate (not shown).

With reference now to FIG. 1(B) it shows the lid after the pressure moulding process according to the invention.

As can be seen, the upper lip 3 has a smaller diameter than the original diameter seen in FIG. 1(A). This is due to the fact that a plurality of reeds is formed on the lip 3 by simultaneous pressure moulding of the both inner and outer surfaces thereof, respectively.

With reference now to FIG. 1(C), it shows a partial section view of three piled up lids, after the pressure moulding process according to the present invention.

As can be seen, the skirt 4 of each lid is apt to engage with the complementary lip 3 of the lid underneath it, thus enabling each lid to be piled up on another lid formed in the same way as the first one.

Figure 2:
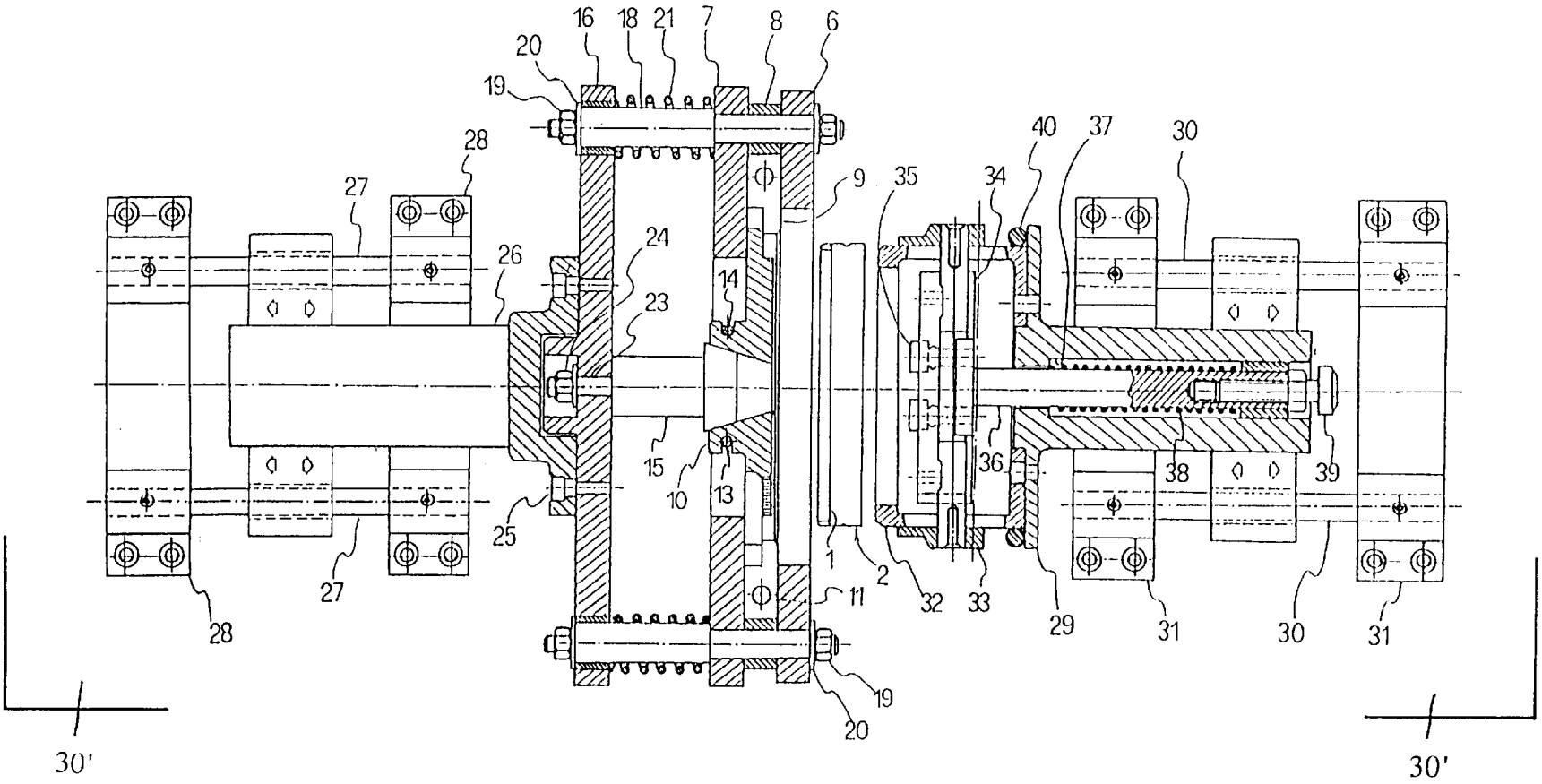
FIG. 2 is a plan view partially in section, which partially shows the apparatus of the present invention.

With reference now to FIG. 2, it shows a plan view, partially in section, of the apparatus according to the present invention.

The apparatus has a first frame formed by a first plate 6 and by a second plate 7, both having an empty central area and spaced from one another by means of four bushings 8 (two of which are shown in the Figure).

In the space between said plates 6 and 7, four external sector elements 9 (only two of which are shown in the Figure and illustrated in greater detail in the following) and four internal sector elements 10 (only two of which are shown in the Figure and illustrated in greater detail in FIG. 4) are slidingly arranged.

Each of said sector elements 9 and 10 is apt to slide in the first frame in a radial direction with respect to the geometric center of said frame, either moving away from or moving towards the latter.

Furthermore, each of the sector elements 9 and 10 has, at the contact surface between one sector element and another, a plurality of indentations (partially shown in the Figure) that are complementary to each other.

Figure 3:
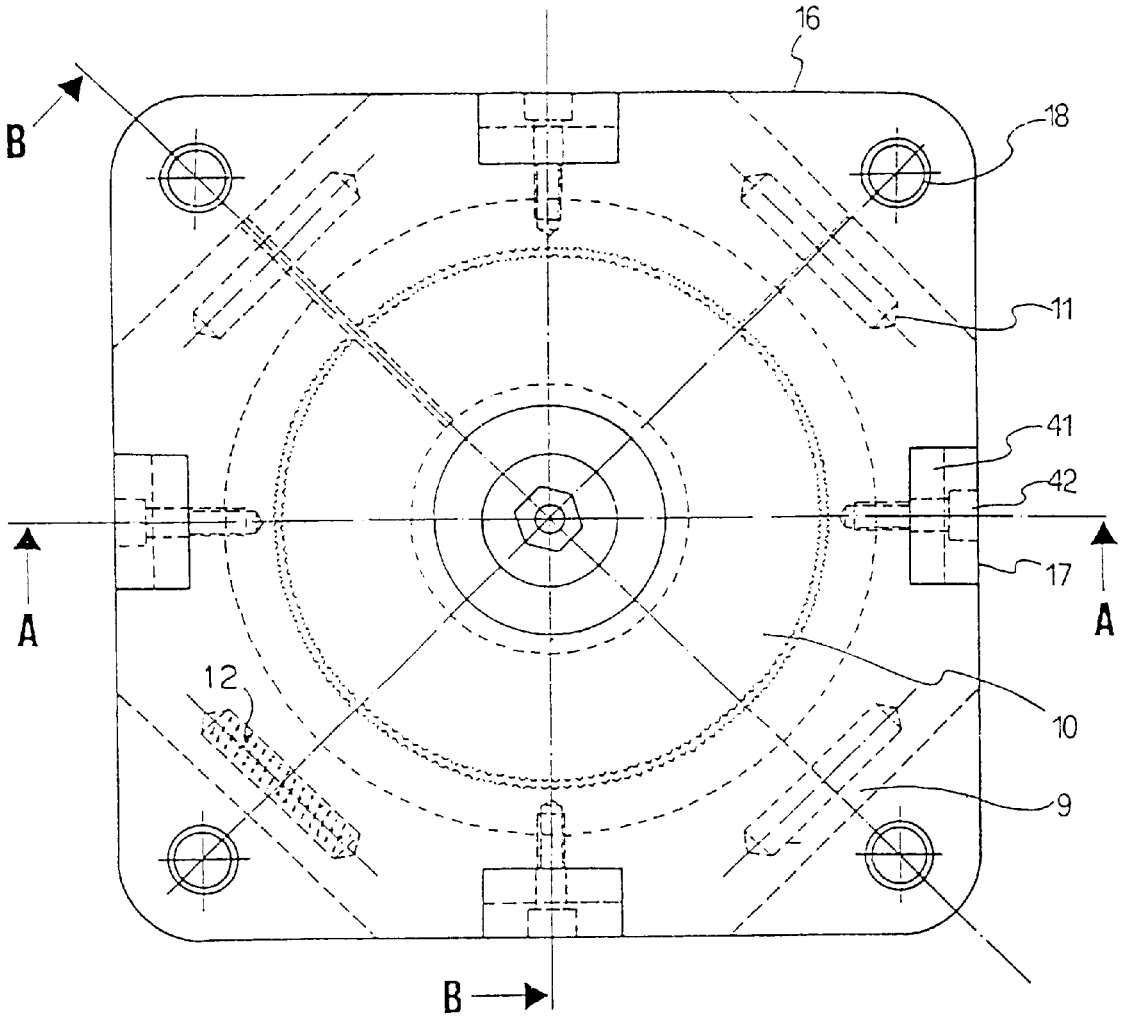
FIG. 3 is a partial front view to implement the process according to a detail of the apparatus of the present invention.

In addition to this, on the inside of each of the sector elements 9 two housings 11 are formed, apt to house respective helical compression springs 12 (shown in FIG. 3).

Figure 4:
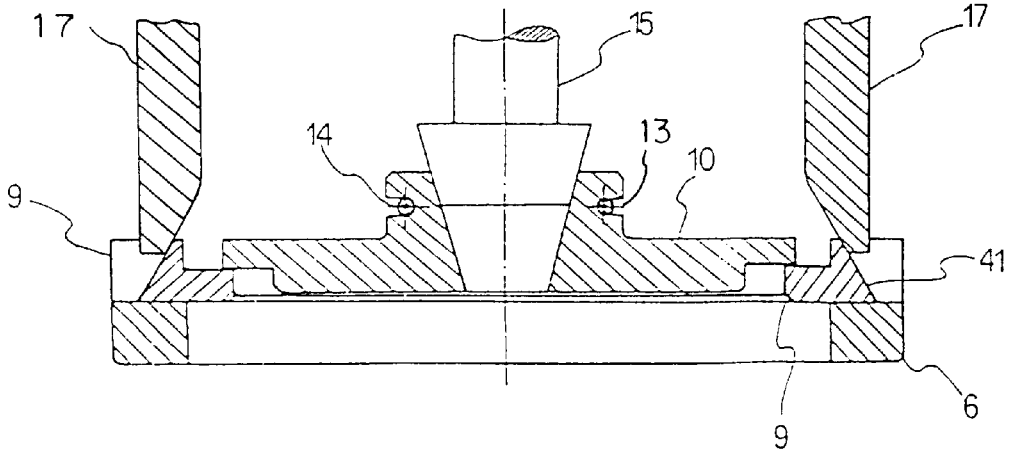
FIG. 4 is a partial cross-section view of the detail of the apparatus shown in FIG. 3, taken along line A—A.

The internal sector elements 10 have, at their central portion, a part that protrudes outwards, on the outside of which a housing 13 is formed, apt to house an elastic toroidal element 14, while on the inside of said protruding part of truncated-cone shaped flaring is formed, apt to engage with a truncated-cone shaped end portion of a thrust element 15 (shown in greater detail in FIG. 4).

The first frame is connected to a second frame, which comprises a plate 16, to which four wedge-shaped thrust elements 17 (not shown in FIG. 2 and described in greater detail in FIGS. 3 and 4) and the above mentioned thrust device 15 are connected. Connection between the first and the second frame is achieved by means of four guide pins 18 (two of which are illustrated in the Figure). The pins 18 are arranged, in a fixed manner, in housings formed on the plates 6 and 7 and in a sliding manner on the plate 16, said pins 18 being held in position by means of respective bolts 19 and washers 20.

Furthermore, the first frame and the second frame are kept spaced from one another under the action of four helical compression springs 21, each of which is coaxially arranged on the respective pin 18.

Figure 5:
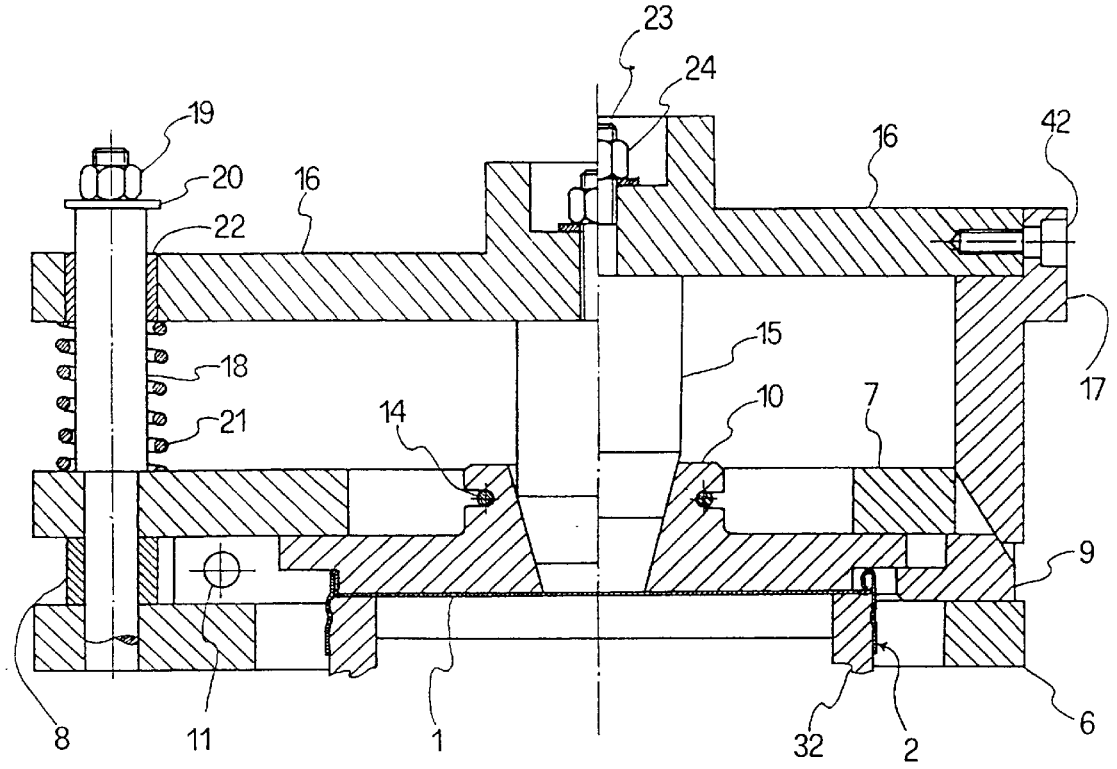
FIG. 5 is a partial cross-section view of the detail of the apparatus shown in FIG. 3, taken along line B—B and showing it in two different conditions.

Again on plate 16, four bushings 22 are provided (two of which are shown in the Figure) as sliding housings for the pins 18 (see also FIG. 5).

The thrust element 15 is integrally arranged at the center of the plate 16 by means of a fixing pin 23 and respective bolt 24.

The second frame is integrally connected by means of pins 25 to a supporting element 26. The latter is apt to slide on a pair of guides 27 connected in a fixed manner to the frame 30' of the apparatus by means of a pair of supports 28.

On the opposite side of the element 26 supporting the first and second frame, a lid bearing element 29 is arranged. The latter is apt to slide on a pair of guides 30, supported on the frame 30' of the apparatus by means of a pair of supports 31.

Furthermore, at the free end of the lid bearing element 29, a cylindrical lid supporting element 32 is integrally arranged. Said cylindrical element 32 is hollow inside and outside it is shaped according to the shape of the lid that is to be arranged on top of it.

Furthermore, outside said element 32, a ring-shaped element 33 is externally arranged in sliding manner for extraction of the lid from the element 32 at the end of the pressure moulding process. The ring-shaped element 33 is engaged internally, by means of screws, to a disc element 34, through passages (two of which are shown in the Figure) formed on the surfaces of the element 32. In turn, the disc element 34 is connected by means of bolts 35 (two of which are shown in the Figure) to a shaft 36 capable of sliding in a housing 37 formed inside the element 29.

The shaft 36 is subjected to the thrust of a spring 38 coaxially arranged on it and capable of returning the former into the rest position. The load on the spring 38 can be adjusted by means of a screw 39 positioned on the opposite end of the shaft 36.

Furthermore, an elastic stop element 40 for the ring-shaped element 33 is arranged between elements 29 and 33, respectively.

In the Figure the arrangement of a lid in the apparatus is also schematically illustrated, before it is positioned on the supporting element 32 prior to the pressure moulding operation.

With reference now to FIG. 3, it shows a partial front view of a detail of the apparatus according to the present invention.

As is more clearly seen, the Figure shows the arrangement of the sector elements 9 and 10 in the first frame. It must be noted that each external sector element 9 has, at its central peripheral area, a flared portion 41 (illustrated in greater detail in FIG. 4) capable of acting as a sliding housing for the wedge-shaped elements 17 integral with the second frame. Furthermore, the wedge-shaped elements 17 are made integral with the plate 16 by means of screws 42 (dash lines in the Figure).

With reference now to FIG. 4, it shows a partial cross-section view of the detail of the apparatus of FIG. 3, taken along line A—A.

As can be more clearly seen, the wedge-shaped element 17 is capable of engaging in a sliding manner with the portion 41 of the external sector element 9, causing the latter to move inwards as a result of lowering of the former.

With reference now to FIG. 5, it shows a partial cross-section view of the detail of the apparatus taken along line B—B of FIG. 3, in the condition preceding and allowing the pressure moulding of the lid, respectively.

As can be seen, the right hand side of the Figure represents the arrangement of the apparatus with the lid in contact with the external and internal sector elements 9 and 10, respectively, before the pressure moulding process.

In the left hand side of the Figure, the condition of the lid after being subjected to the reeding pressure moulding is shown, resulting in a decrease in the diameter of the upper lip 3, following reciprocal approach of the sector elements 9 and 10, respectively.

Figure 6:
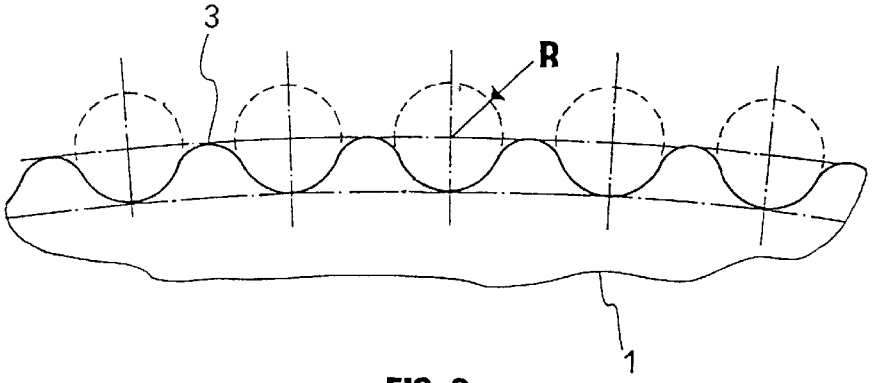
FIG. 6 is a detailed partial view of the superficial shape of the upper lip of the lid after the pressure moulding process according to the present invention.

With reference to FIG. 6, it shows a detailed partial view of the surface shape of the upper lip of the lid, after the pressure moulding process according to the present invention.

As can be seen, the surface reeding of the lip 3 is brought about by cylindrically toothed indentations with an involute of radius R, formed on the contact surfaces of the external and internal sector elements 9 and 10, respectively (not shown in the Figure).

In operation, the lid is first arranged on the supporting element 32. Then the elements 26 and 29 are brought together, in a synchronous manner by means of first thrust means not shown in the Figure, as these form part of the state of the art, until the element 32 and therefore the lid arranged thereon, come in contact with the sector elements 9 and 10 in the first frame.

Subsequently, the element 26 is further pressed against the element 32, thus causing the second frame to come still closer to the first frame, against the action of the springs 21. To the approach of the second frame to the first frame, there is a corresponding of the thrust element 15 and of the wedge-shaped elements 17 to the sector elements 10 and 9.

In this way, the thrust element 15 and the wedge-shaped elements 17 by engaging in the respective flared portions of the sector elements 10 and 9, cause the latter mutually to approach in a synchronous manner against the push of the springs 12 and 14 until contacting the upper lip 3 of the lid arranged between them, producing a reeding pressure moulding on the latter.

This pressure moulding reduces the diameter of the lip 3 due to creation on the latter of a plurality of complementary indented reedings, formed on the contact surface of each internal and external sector element 9 and 10, respectively.

Therefore, again by means of said first thrust means, the elements 26 and 32 are moved away from each other. This causes the internal and external sector elements 9 and 10 to move away from each other, under the action of the return force of the springs 12 and 14, respectively, as well as the moving of the first frame away from the second frame under the action of the springs 21.

Simultaneously, the lid formed in this way is moved from the first frame and then extracted from the supporting element 32 by the element 33, connected with the shaft 36, by second thrust means (not shown).

In this sate the apparatus is ready to perform a second full cycle, after a new lid has been positioned on the supporting element 32.

It is clear that the invention is not limited to the embodiment described above, but comprises any variant of embodiment, in articular the ones which can be applied to lids of non-circular shape, for example ellipsoidal lids, square lids, etc.

What is claimed is:

1. A process for the production of pile-up lids, each of which is formed by a closing upper wall (1) and by an element (2) arranged around the perimeter of said upper wall (1) and which forms an upper lip (3) protruding above said upper wall (1), and a skirt (4) extending below said upper wall (1);

the process being characterized by the following steps:

positioning an unfinished lid on a supporting element (32);

bringing said supporting element (32) near an area in a first frame (6, 7) that is delimited by a plurality of first external sector elements (9) and by a plurality of second internal sector elements (10), until said lid comes into contact with said first external and said second internal sector elements (9, 10) having respective indentations on the respective contact surfaces; and bringing said first external sector elements (9) and said second internal sector elements (10) together in synchrony in radially opposite directions by bringing a second frame (16) and said first frame (6, 7) together, said first external and said second internal sector elements (9, 10) being slidingly movable in the same plane on said first frame (6, 7) in such a way that, each time said second frame (16) approaches or moves away from said first frame (6, 7), there is a corresponding mutual movement, in the approaching or moving away direction, respectively, of said first external and said second internal sector elements (9, 10) orthogonal to the direction of the movement of the second frame (16), said orthogonal movement, when in said approaching direction, causing the forced approach of said contact surfaces of said first external and said second internal sector elements (9, 10) with said upper lip (3) of said lid inserted between said first external and said second internal sector elements (9, 10), thereby carrying out a reeding pressure moulding on both external and internal surfaces of said upper lip (3), to thereby provide said upper lip (3) with a reduced perimeter outline to allow piling up on other similar lids after extraction of the lid from said supporting element (32).

* * * * *